US005394157A

United States Patent [19]

Garneski

[11] Patent Number: 5,394,157

[45] Date of Patent: Feb. 28, 1995

[54] METHOD OF IDENTIFYING ANTENNA-MODE SCATTERING CENTERS IN ARRAYS FROM PLANAR NEAR FIELD MEASUREMENTS

[75] Inventor: Dayel R. Garneski, Long Beach, Calif.

[73] Assignee: Hughes Aircraft Company, Los Angeles, Calif.

[21] Appl. No.: 155,320

[22] Filed: Nov. 22, 1993

[51] Int. Cl.[6] ..... H01Q 3/00

[52] U.S. Cl. ..... 342/360; 342/351; 343/703

[58] Field of Search ..... 342/360, 351; 343/703

[56] References Cited

U.S. PATENT DOCUMENTS

| | | | |
|---|---|---|---|
| 4,453,164 | 6/1984 | Patton | 342/360 |
| 5,119,105 | 6/1992 | Ngai et al. | 343/703 |
| 5,278,571 | 1/1994 | Helfrick | 343/703 |

*Primary Examiner*—Theodore M. Blum
*Attorney, Agent, or Firm*—Leonard A. Alkov; Wanda K. Denson-Low

[57] ABSTRACT

A method of identifying antenna-mode scattering centers in an aperture device or array from planar near field measurements. Antenna-mode scattering centers may be determined for aperture assemblies, phenomenological models of apertures, and antenna arrays comprising a feed and an array of antenna elements. The method uses a scanning probe and receiver for making near field measurements. A feed horn and signal source illuminates the device. An absorber is disposed between the device and the probe and this combination is illuminated. A first set of data is collected over a planar surface in a near field region of the device. The device is then illuminated with the absorber removed. A second set of data is collected over a planar surface in a near field region of the device. The difference between the first and second sets of data is determined to provide data indicative of the near field response of the probe to the near field scattered from the device. Data indicative of the scattered far field from the device is computed using a planar near-to-far-field transform. The computed far field data is then converted from probe coordinates to device coordinates. The converted far field data is equated to data corresponding to the far field of an array device whose excitation weights are a product of a reflection coefficient looking into the feed at a junction between an antenna element and the feed, and a horn-element coupling factor between the feed horn and an antenna element that is proportional to power received by an individual antenna element from the feed horn. A copolarized component of the far field is divided by a copolarized component of an embedded element pattern to produce a scalar array pattern. The excitation weights are determined using an inverse fast Fourier transform (FFT) of the scalar array pattern. The reflection coefficients are determined by dividing the excitation weights by the horn-element coupling factor. Finally the antenna-mode scattered far field may be computed for an arbitrary incident plane wave having the predetermined angle of arrival and polarization at a predetermined frequency, which antenna-mode scattered far field is indicative of the antenna-mode scattering centers in the device.

6 Claims, 3 Drawing Sheets

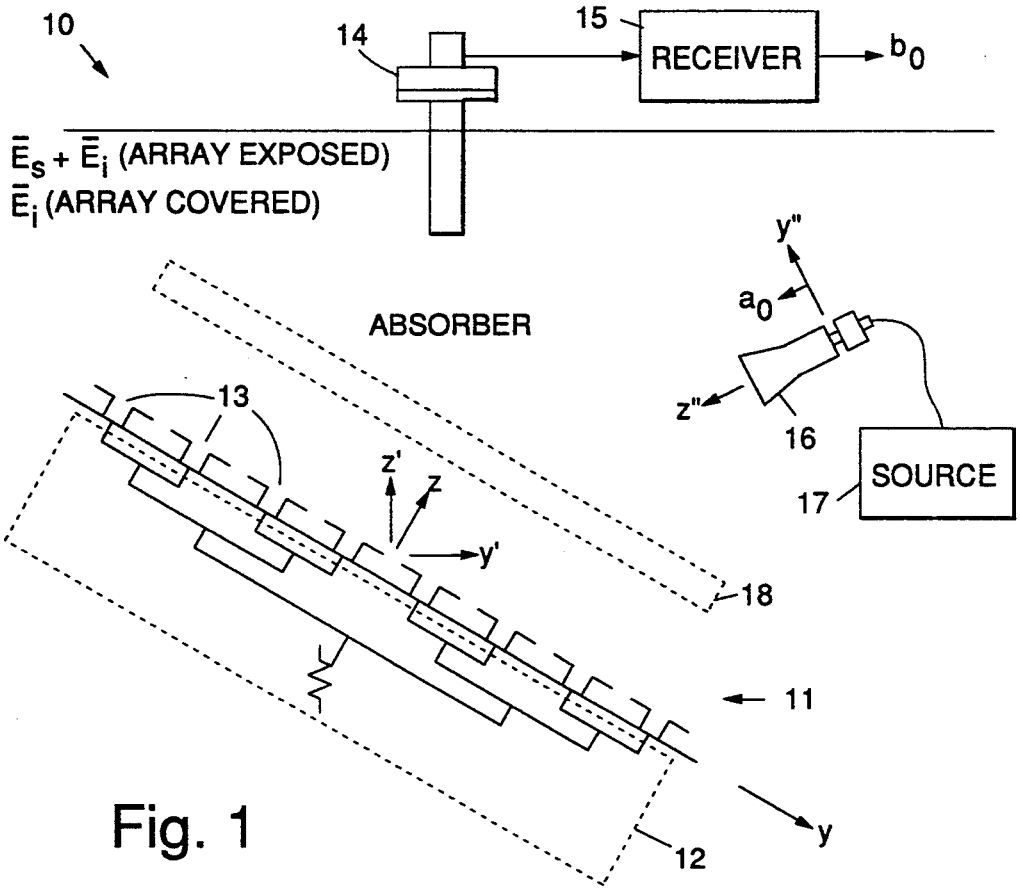
Fig. 1
Fig. 2
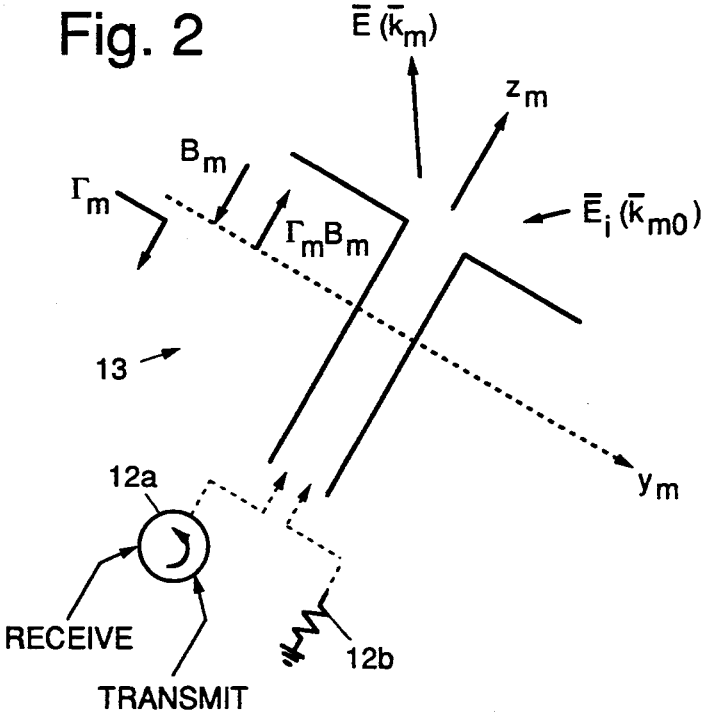

METHOD OF IDENTIFYING ANTENNA-MODE SCATTERING CENTERS IN ARRAYS FROM PLANAR NEAR FIELD MEASUREMENTS

BACKGROUND

The present invention relates to array antennas, and more particularly, to a method of identifying antenna-mode scattering centers in arrays from planar near field measurements.

The current practice of identifying antenna-mode scattering centers in arrays is to image backscattered energy on a radar cross section measurement range. These images do not generally provide sufficient resolution to isolate the scattering to a specific array element, and often contain artifacts which may lead to ambiguous results. In addition, this radar cross section range technique involves swept frequency measurements, since backscattering from within the feed may occur only over a narrow frequency band, and the results may not indicate the true magnitude of the scattering over this narrow band.

A second, less frequently used technique, is to build a custom hand-held probe that mechanically couples to array elements. Disadvantages of this technique are that is time-consuming and inaccurate to the extent that the results are affected by how the probe is positioned against an element. This technique cannot be applied to reactively-fed elements due to mutual coupling effects. Furthermore, it is difficult to implement for certain types of elements due to their physical characteristics.

In the design of array apertures used in low observability radar systems, phenomenological models are constructed for the purpose of characterizing, among other things, the radar cross section performance of an antenna aperture. Also, it is necessary to screen aperture assemblies, comprising array elements and embedded circulators, for defects that lead to degraded RCS performance, in connection with production of new-generation active array antennas. A contributing factor to this performance is so-called antenna-mode scattering, which is comprised of energy received by array elements, reflected from the array feed system, and reradiated by the elements. In the process of testing an aperture assembly or phenomenological model on an radar cross section range, there are occasions where the antenna-mode scattering exceeds expectations, from which it can be deduced that significant scattering is occurring within the feed system. An image of this scattered energy may then be produced from the data obtained on the radar cross section range. For this image to be useful, it must resolve scattering centers sufficiently to allow their attribution to individual array elements. However, images so produced do not provide this degree of resolution, and also include artifacts which may add to the ambiguity of the image. Therefore, feed system scattering cannot be localized with a high degree of confidence, and correction of the problem is correspondingly more difficult or unfeasible.

Therefore, it is an objective of the present invention to provide a method of identifying antenna-mode scattering centers in arrays from planar near field measurements that has sufficient resolution and is relatively free of artifacts to provide for useful data.

SUMMARY OF THE INVENTION

In order to meet the above and other objectives, the present invention is a method of identifying antenna-mode scattering centers in arrays from planar near field measurements. The method identifies antenna-mode scattering centers in aperture assemblies, phenomenological models of apertures, and in antenna arrays comprising a corporate feed coupled to an array of antenna elements. The antenna arrays, aperture assemblies, and phenomenological models are generically referred to herein as "aperture devices" and this term is used to describe the present invention. The method uses the scanning probe coupled to the receiver and the probe is disposed adjacent to the aperture device for making near field measurements. The transmitter feed horn is coupled to a signal source for illuminating the aperture device. The present method comprises the following steps.

The aperture device may be aligned parallel to or tilted with respect to a scan plane of the scanning probe such that both the normal to the scan plane and the normal to an aperture of the feed horn are at predetermined nonextreme angles with respect to a boresight of the device. An absorber is disposed between the aperture device and the probe and this combination is illuminated with signals derived from the signal source using the transmitting horn. A first set of data is collected over a planar surface in a near field region of the aperture device using the scanning probe. The aperture device is then illuminated with signals derived from the signal source using the transmitting horn with the absorber removed. A second set of data is collected over a planar surface in a near field region of the aperture device using the scanning probe. The difference between the first and second sets of data is determined to provide data indicative of the near field response of the probe to the near field scattered from the aperture device.

Data indicative of the scattered far field from the aperture device due to illumination from the horn is computed using a planar near-to-far-field transform. The computed far field data is then converted from probe coordinates to aperture device coordinates. The converted far field data is equated to data corresponding to the far field of a device whose excitation weights are a product of a reflection coefficient looking into the feed at a junction between an element and the feed, and a horn-element coupling factor between the feed horn and an antenna element that is proportional to power received by an individual antenna element from the feed horn. A copolarized component of the far field is divided by a copolarized component of an embedded element pattern to produce a scalar array pattern. The excitation weights are determined using an inverse fast Fourier transform (FFT) of the scalar array pattern. The reflection coefficients are determined by dividing the excitation weights by the horn-element coupling factor. Finally the antenna-mode scattered far field may be computed for an arbitrary incident plane wave having a predetermined angle of arrival and polarization at the predetermined frequency, which antenna-mode scattered far field is indicative of the antenna-mode scattering centers in the aperture device.

In the present invention, antenna-mode scattering centers in aperture devices, or more specifically, a map of the reflection coefficients looking into the feed system from element-feed junctions, are obtained from simple measurements on a planar near field range. This represents a more effective and convenient diagnostic capability for locating and quantifying backscatter originating from within the feed system than currently used techniques provide. In addition, estimates of the antenna-mode component of the scattered far field are possible without testing on a radar cross section range.

The planar near field method of the present invention provides for sufficient resolution and is relatively free of artifacts. In addition, the present method yields actual reflection coefficients rather than relative data, such that the antenna-mode component of the scattered field may be estimated without testing on an radar cross section range. Because the reflection coefficient phase is also available, it is possible to determine the depth of reflecting obstacles within the feed system by obtaining data over a range of frequencies. The present invention is relatively fast and convenient. Arrays undergoing testing for patterns and gain in a planar near field range may be tested as well for feed system scattering with little additional effort.

In contrast to the above-described first technique, the present planar near field technique provides superior resolution and can resolve scattering from individual array elements. It provides images relatively free of artifacts, and because measurements are taken at a single frequency (or multiplexed set of frequencies) where it is known that feed system scattering may be significant, good images of this scattering are obtained. In contrast to the above-described second technique, the present planar near field technique is relatively fast and convenient, and may be applied to any array.

Development of array apertures is more efficient using the present invention in that phenomenological models may be quickly screened for defects before costly testing on a radar cross section range, and preliminary estimates of the antenna-mode scattered field may be quickly made. Conversely, when arrays or models exhibit unexpectedly high antenna-mode scattering performance on a radar cross section range, an accurate diagnosis of the feed scattering may be made using the present invention. During array production, feed scattering may be characterized with little additional effort while testing for patterns and gain on a planar near field range. Using conventionally available practices, this additional data is not available.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 illustrates a test setup for testing an antenna array using a method of identifying antenna-mode scattering centers in accordance with the principles of the present invention;

FIG. 2 is an enlarged view of one of the radiating elements of the antenna array of FIG. 1.

DETAILED DESCRIPTION

Figure 3A:
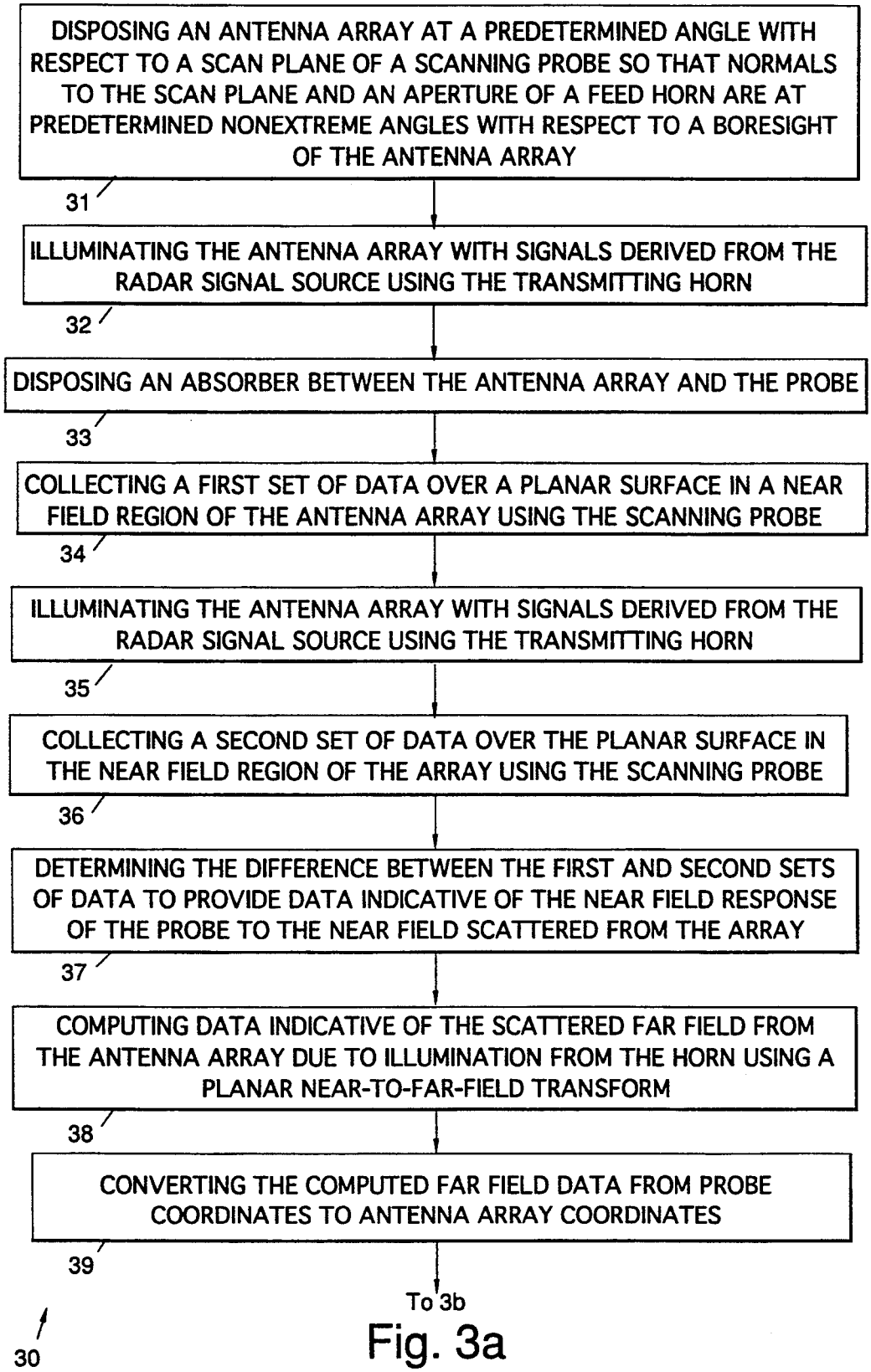
FIG. 3 is a flow diagram illustrating the details of the present method used in the test setup of FIG. 1.

Referring to the drawing figures, FIG. 1 illustrates a test setup 10 that is used to test an aperture device 11, or more specifically, an antenna array 11 using a method 30 (FIG. 3) of identifying antenna-mode scattering centers in accordance with the principles of the present invention. FIG. 2 is an enlarged view of one of the radiating elements 13 of the antenna array 11 of FIG. 1. It is to be understood that other aperture devices 11 may be tested using the present invention, and such aperture devices 11 include antenna arrays 11, aperture assemblies, and phenomenological models, and the like.

FIGS. 1 and 2, specifically address testing of an antenna array, 11, and the antenna array 11 comprises a feed 12, such as a corporate feed 12 that interconnects the antenna array 11 comprising a plurality of radiating elements 13. FIG. 2 also shows alternative feeds **12*a*, 12*b* comprising circulators 12*a* that may be used for aperture assemblies and internal load circuits 12*b* that may be used for phenomenological models. A scanning probe 14 is disposed parallel to or at an angle relative to a radiating axis of the antenna array 11 and the probe 14 is coupled to a receiver 15. The antenna array 11 is thus parallel to or tilted relative to the scanning probe 14. A transmitting feed horn 16 is also disposed adjacent the antenna array 11 and is coupled to a signal source 17. An absorber 18 is selectively disposed between the antenna array 11 and the probe 14 during implementation of the present testing method 30. The transmitting feed horn 16 is adapted to radiate the antenna array 11 with signals derived from the signal source 17**.

The present method 30 comprises illuminating the antenna array 11 with signals emanated from the transmitting feed horn 16 in the manner of an offset reflector system. The antenna array 11 and feed horn 16 are situated beneath or in front of the scanning probe 14 which collects data over a planar surface in the near field region of the radiating antenna array 11. The antenna array 11 may be tilted with respect to a scan plane of the scanning probe 14 such that both the normal to the scan plane and the normal to the aperture of the feed horn 16 are not at extreme angles with respect to the boresight of the element pattern of the antenna array 11.

Near field data are collected with and without the absorber 18 disposed between the antenna array 11 and the probe 14, such as is obtained by covering the face of the antenna array 11 with the absorber 18, for example. The difference between the two sets of data, representing the response of the probe 14 to the scattered field alone, is determined. If the response derived from an orthogonally polarized probe 14 is significant, this data may also be included in the present method 30. The scattered far field due to illumination from the feed horn 16 is computed using the well-known planar near-to-far-field transform including probe correction. The resulting far field data are converted from probe 14 coordinates to array coordinates, and equated with an expression for the far field of an array whose excitation weights are the product of the reflection coefficient looking into its feed at an element-feed junction, and a horn-element coupling factor proportional to the power received by an individual array element from the feed horn.

A scalar array pattern is obtained by dividing a copolarized component of the far field by a copolarized component of the embedded element pattern, and the excitation weights are found using an inverse fast Fourier transform (FFT) of the array pattern. The reflection coefficients are found by dividing the excitation weights by the horn-element coupling factor. The horn-element coupling factor is found as an absolute quantity, taking into account the geometry of the test setup, the complete embedded element and horn pattern characteristics, and their gains. The field of the feed horn 16 may be measured or theoretical. Because the far field is computed in absolute terms, the reflection coefficient represents a true voltage ratio rather than a relative quantity.

From knowledge of the reflection coefficients looking into the feed 12 from the element-feed junctions and the embedded element pattern, the antenna-mode scattered far field may be computed for an arbitrary incident plane wave having a predetermined angle of arrival and polarization at the test frequency. This is true even though, in the present method 30, the antenna array 11 is illuminated by the horn 14 located in the near field. This plane wave is arbitrary in that it is not related to the geometry of the test setup 10.

The resolution cell is roughly a circle having a radius of 0.6 wavelength, and is much better than is typically obtained on an radar cross section range. A resolution limit is encountered because the present method 30 is essentially a "back projection" technique, whereby an aperture field is reconstructed excluding evanescent energy that is present on the aperture of the antenna array 11 but is unmeasurable by the probe 14.

The validity of the present method 30 rests upon the following assumptions. The measured scattered field is predominantly antenna-mode. The antenna array 11 possesses a common embedded element pattern. The embedded element pattern has no nulls over the far field region included in the processing; individual array elements 13 see a local plane wave illumination from the feed horn 16, although the feed horn 16 is in the near field of the entire array. The antenna-mode scattered field is much larger than that scattered by the absorber during the measurement. To date, the results obtained from tests suggest that these assumptions are realistic.

Figure 3B:
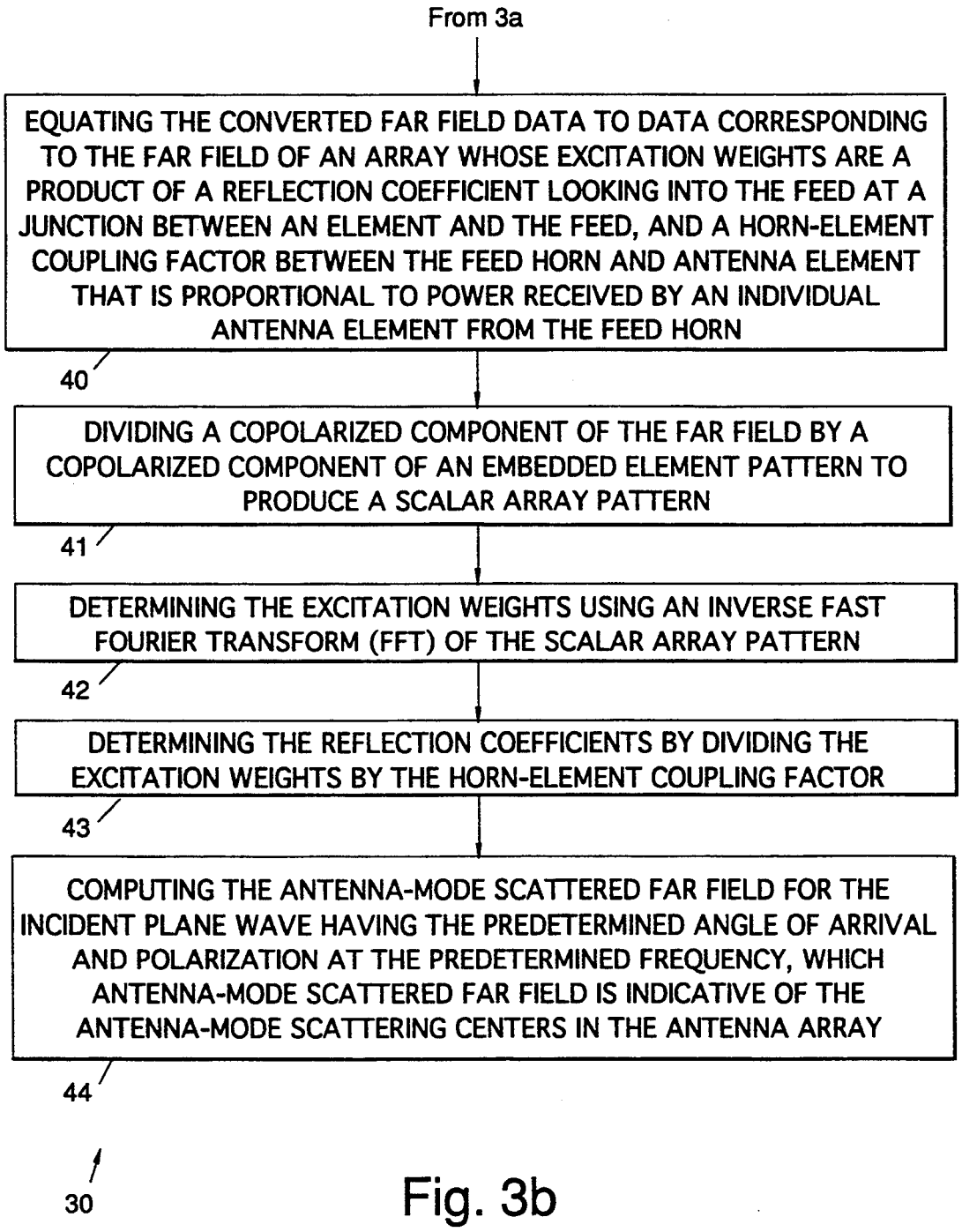

For the purposes of completeness, reference is made to FIG. 3, which is a flow diagram illustrating the details of the present method 30 used in the test setup 10 shown in FIG. 1. The present method 30 is a method of identifying antenna-mode scattering centers in aperture devices 11, such as the antenna array 11, aperture assemblies, or phenomenological models, or the like. The aperture device 11 comprises the feed 12 coupled to the array of antenna elements 13, for example, and the scattering centers are derived from planar near field measurements. The method 30 uses the scanning probe 14 coupled to the receiver 15 and the probe 14 is disposed adjacent to the aperture device 11 for making near field measurements. The transmitter feed horn 16 is coupled to the signal source 17 for illuminating the antenna array 11. The present method 30 comprises the following steps.

The aperture device 11 is aligned at a predetermined angle (parallel or tilted) with respect to a scan plane of the scanning probe 14 such that both the normal to the scan plane and the normal to an aperture of the feed horn 16 are at predetermined nonextreme angles with respect to a boresight of the aperture device 11, as is indicated in step 31. The aperture device 11 is illuminated with signals derived from the signal source 17 using the transmitting horn 16, as is indicated in step 32. The absorber 18 is disposed between the aperture device 11 and the probe 14, as is indicated in step 33. A first set of data is collected over a planar surface in a near field region of the aperture device 11 using the scanning probe 14, as is indicated in step 34. The aperture device 11 is illuminated with signals derived from the signal source 17 using the transmitting feed horn 16, as is indicated in step 35. A second set of data is collected over a planar surface in a near field region of the aperture device 11 using the scanning probe 14 with the absorber 18 removed, as is indicated in step 36. The difference between the first and second sets of data is determined to provide data indicative of the near field response of the probe 14 to the near field scattered from the aperture device 11, as is indicated in step 37.

Data indicative of the scattered far field from the aperture device 11 due to illumination from the feed horn 16 is computed using a planar near-to-far-field transform, as is indicated in step 38. The computed far field data is then converted from probe coordinates to antenna array coordinates, as is indicated in step 39. The converted far field data is equated to data corresponding to the far field of an aperture array device whose excitation weights are a product of a reflection coefficient looking into the feed at a junction between an element and the feed, and a horn-element coupling factor between the feed horn and antenna element that is proportional to power received by an individual antenna element from the feed horn, as is indicated in step 40. A copolarized component of the far field is divided by a copolarized component of an embedded element pattern to produce a scalar array pattern, as is indicated in step 41. The excitation weights are determined using an inverse fast Fourier transform (FFT) of the scalar array pattern, as is indicated in step 42. The reflection coefficients are determined by dividing the excitation weights by the horn-element coupling factor, as is indicated in step 43. Finally the antenna-mode scattered far field may be computed for an arbitrary incident plane wave having a predetermined angle of arrival and polarization at the predetermined frequency, which antenna-mode scattered far field is indicative of the antenna-mode scattering centers in the aperture device 11, as is indicated in step 44.

In order to better understand the present invention, the equations used to implement the present method and underlying definitions are presented below. The following definitions are employed. The term $\bar{s}_R$ is a receive characteristic of an embedded element, and is common to all elements of the antenna array. The term $\bar{s}_T^H$ is a transmit characteristic of the feed horn. The term $\bar{s}_T$ is the transmit characteristic of the scattered field. The term $a_0$ is the mode voltage accepted by the feed horn at the feed horn-source junction. The term $B_m$ is the mode voltage incident upon the $m^{th}$ feed port from the $m^{th}$ antenna element. The term $a_{0m}=\Gamma_m B_m$ is the mode voltage accepted by the $m^{th}$ element from the $m^{th}$ feed port. $\bar{k}=2\pi/\lambda\hat{k}$ is the vector wave number defining frequency and direction of propagation of a plane wave. $\bar{k}_{m0}=2\pi/\lambda\hat{k}_{m0}$ is the vector wave number corresponding to a plane wave incident upon the $m^{th}$ element from the feed horn. The term $\bar{E}_s$ is the scattered electric field. The term $\bar{E}_i$ is the incident electric field. $\gamma=\hat{z}\cdot\bar{k}$ is the z component of the vector wavenumber$=k\cos(\theta)$. $\bar{K}=\bar{k}-\hat{z}\gamma$ is the transverse component of the vector wavenumber. The term $\bar{R}_m$ is the location of the $m^{th}$ element in the scatterer coordinates. The term $\Gamma_m$ is the reflection coefficient looking into the $m^{th}$ feed port from the $m^{th}$ element and corresponds to the outcome of the present method. The term $e^{-i\omega t}$ represents time assumed in the following derivation.

The plane wave scattering matrix equations are as follows.

Reciprocity:

$$\bar{s}_{01}(-\bar{k}) = \frac{\gamma}{k}\bar{s}_{10}(\bar{k}), \bar{s}_{10}(\bar{k}) = \frac{k}{\gamma}\bar{s}_{01}(-\bar{k}) \quad (1)$$

Far field: $\bar{E}(\bar{k}) = -ia_{0\gamma}(\bar{k})\bar{s}_{10}(\bar{k})e^{ikr}/r$ (2)

From (1): $\bar{E}(\bar{k}) = -ia_0\bar{k}\bar{s}_{01}(-\bar{k})e^{ikr}/r$ (3)

Define $\bar{s}_{01}(-\bar{k}) = \bar{s}_R(\bar{k})$ = receive characteristic corresponding to transmitted wave $\bar{k}$ (4)

Define $\bar{s}_{10}(\bar{k}) = \bar{s}_T(\bar{k})$ (5) = alternative notation for the transmission characteristic.

Scaling of receive characteristic:

$$|\bar{s}_R(\bar{k})| = \left|\frac{(1-|\Gamma|^2)G(k)}{4\pi k^2}\right|^{\frac{1}{2}} \quad (6)$$

where Γ, G(k) are the average reflection coefficients and gain of an embedded array element, respectively.

For the field due to the array:

$$\bar{E}(\bar{k}) = -ik\sum_{m=1}^{M} a_{0m}\bar{s}_{Rm}(\bar{k})e^{ikr_m}/r_m \quad (7)$$

$$\bar{s}_R(\bar{k}) = \bar{S}_{Rm}(k) \text{ for all } m \text{ (common embedded element)} \quad (8)$$

$$\bar{E}(\bar{k}) \approx -ik\bar{s}_R(\bar{k})\frac{e^{ikr}}{r}\sum_{m=1}^{M} a_{0m}e^{-ik\hat{r}\cdot\bar{R}_m} \quad (9)$$

Equate the array field to the measured scattered far field computed from a planar near field to far field transformation of the scattered near field $$a_{0m} = \Gamma_m B_m \quad (10)$$

$$-ik\bar{s}_R(\bar{k})\frac{e^{ikr}}{r}\sum_{m=1}^{M}\Gamma_m B_m e^{-ik\hat{r}\cdot\bar{R}_m} = -ia_{0\gamma}(\bar{k})\bar{s}_T(\bar{k})e^{ikr}/r \quad (11)$$

Dot bot sides with the principal component unit vector and introduce double subscripts.

$$\sum_{n=1}^{N}\sum_{m=1}^{M}\Gamma_{mn}B_{mn}e^{-ik\hat{r}\cdot\bar{R}_{mn}} = a_0\cos\theta\cdot\frac{\bar{s}_T(\bar{k})\cdot\hat{p}}{\bar{s}_R(\bar{k})\cdot\hat{p}} \quad (12)$$

Obtain the DFT form:

$$k\hat{r}\cdot\bar{R}_{mn} = k_x(m-1)\Delta x + k_y(n-1)\Delta y, \quad (13)$$

$$k_x = (I-1)\cdot\frac{2\pi}{M\Delta x},\ k_y = (J-1)\frac{2\pi}{M\Delta y}$$

where m=1, 2, . . . M; n=1, 2, . . . N; J=1, 2, . . . M; J=1, 2, . . . N $$\sum_{n=1}^{N}\sum_{m=1}^{M}\Gamma_{mn}B_{mn}e^{-i2\pi(I-1)(m-1)/Me-i2\pi(J-1)(n-1)/N} = a_0\cos\theta(I,J)\frac{\bar{s}_T(I,J)\cdot\hat{p}}{\bar{s}_R((I,J))\cdot\hat{p}} \quad (14)$$

-continued $$\Gamma_{mn} = \frac{a_0}{B_{mn}}DFT^{-1}\left[\cos\theta(I,J)\cdot\frac{\bar{s}_T(I,J)\cdot\hat{p}}{\bar{s}_R((I,J))\cdot\hat{p}}\right] \quad (15)$$

Determination of $B_{mn}$:

$$B_{mn} = -2\pi ia_{0\gamma}(\bar{k}''(\bar{k}_{m0}))\bar{s}_T{}^H(\bar{k}''(\bar{k}_{m0}))\cdot\bar{s}_R(\bar{k}_{m0}) \quad (16)$$

which assumes locally incident plane wave at $m^{th}$ element.

To better understand the theory employed in the present invention, reference is made to "Plane-wave Scattering Matrix Theory of Antennas and Antenna-Antenna Interactions", by D. H. Kerns, National Bureau of Standards Monograph 162, 1981.

The horn pattern $\gamma\bar{s}_T{}^H$ is computed from a theoretical model. The embedded element pattern $\bar{s}_R$ is either measured or theoretical. Several coordinate transformations and transformations of vector components are required but not detailed here. The scattered far field $\bar{s}_T$ is the outcome of a conventional near field-far field computation with probe correction, but transformed to scatterer coordinates.

Thus there has been described a new and improved method of identifying antenna-mode scattering centers in arrays from planar near field measurements. It is to be understood that the above-described embodiment is merely illustrative of some of the many specific embodiments which represent applications of the principles of the present invention. Clearly, numerous and other arrangements can be readily devised by those skilled in the an without departing from the scope of the invention.

What is claimed is:

1. A method of identifying antenna-mode scattering centers in an aperture device comprising a feed coupled to an array of antenna elements, which scattering centers are derived from planar near field measurements, which method is employed with a scanning probe that is coupled to a receiver and which is disposed adjacent to the aperture device for making the near field measurements, and a transmitter feed horn coupled to a signal source for illuminating the aperture device, said method comprising the steps of:

disposing the aperture device at a predetermined angle with respect to a scan plane of the scanning probe such that both the normal to the scan plane and the normal to an aperture of the feed horn are at a predetermined nonextreme angle with respect to a boresight of the aperture device;

illuminating the aperture device with signals derived from the signal source using the transmitting horn;

disposing an absorber between the aperture device and the probe;

collecting a first set of data over a planar surface in a near field region of the aperture device using the scanning probe;

illuminating the aperture device with signals derived from the signal source using the transmitting horn;

collecting a second set of data over the planar surface in the near field region of the radiating aperture device using the scanning probe;

determining the difference between the first and second sets of data, to provide data indicative of the near field response of the probe to the near field scattered from the aperture device;

computing data indicative of the scattered far field from the aperture device due to illumination from the horn using a planar near-to-far-field transform;

converting the computed far field data from probe coordinates to aperture device coordinates;

equating the converted far field data to data corresponding to the far field of an array device whose excitation weights are a product of a reflection coefficient looking into the corporate feed at a junction between an element and the corporate feed, and a horn-element coupling factor between the feed horn and antenna element that is proportional to power received by an individual antenna element from the feed horn;

dividing a copolarized component of the far field by a copolarized component of an embedded element pattern to produce a scalar array pattern;

determining the excitation weights using an inverse fast Fourier transform (FFF) of the scalar array pattern;

determining the reflection coefficients by dividing the excitation weights by the horn-element coupling factor; and computing the antenna-mode scattered far field for an arbitrary incident plane wave having a predetermined angle of arrival and polarization at the predetermined frequency, which antenna-mode scattered far field is indicative of the antenna-mode scattering centers in the aperture device.

2. The method of claim 1 wherein the aperture device comprises an antenna array.

3. The method of claim 1 wherein the aperture device comprises an aperture assembly.

4. The method of claim 1 wherein the aperture device comprises a phenomenological model.

5. The method of claim 1 wherein the field derived from the feed horn comprises measured data.

6. The method of claim 2 wherein the field derived from the feed horn comprises theoretical data.

* * * * *